US005816559A

United States Patent [19]

Fujimoto

[11] Patent Number: 5,816,559

[45] Date of Patent: Oct. 6, 1998

[54] SEISMIC ISOLATION DEVICE

[75] Inventor: Shigeru Fujimoto, Yokohama, Japan

[73] Assignee: Kabushiki Kaisha Toshiba, Kawasaki, Japan

[21] Appl. No.: 816,647

[22] Filed: Mar. 13, 1997

[30] Foreign Application Priority Data

Mar. 13, 1996 [JP] Japan ..... 8-055657

[51] Int. Cl.[6] ..... E04H 9/02

[52] U.S. Cl. ..... 248/636; 52/167.6; 248/562; 248/638

[58] Field of Search ..... 248/562, 619, 248/636, 638; 52/167.4, 167.5, 167.6

[56] References Cited

U.S. PATENT DOCUMENTS 4,662,133 5/1987 Kondo .

FOREIGN PATENT DOCUMENTS 62-278335 12/1987 Japan .
3-183864 8/1991 Japan .

*Primary Examiner*—Ramon O. Ramirez
*Assistant Examiner*—Derek J. Berger
*Attorney, Agent, or Firm*—Oblon, Spivak, McClelland, Maier & Neustadt, P.C.

[57] ABSTRACT

A seismic isolation device comprises a floor body which is arranged on a structural floor and to which an object of seismic isolation is mounted, a first restoring member disposed on the structural floor and adapted to impart a horizontal restoring force to the floor body when the floor body is horizontally displaced with respect to the structural floor, a first damping member arranged in association with the first restoring member and adapted to impart a horizontal damping force when the floor body is horizontally displaced with respect to the structural floor, a first engaging member projecting from the floor body towards the structural floor, a second engaging member provided on the first restoring member and sliding while coming into contact with the first engaging member, a second restoring member disposed to a lower portion of the floor body and adapted to impart a vertical restoring force when the floor body is vertically displaced with respect to the structural floor, a second damping member arranged in association with the second restoring member and adapted to impart a vertical damping force when the floor body is vertically displaced with respect to the structural floor, and a support mechanism for supporting the floor body to be movable in a horizontal direction.

21 Claims, 12 Drawing Sheets

SEISMIC ISOLATION DEVICE

BACKGROUND OF THE INVENTION

The present invention relates to a seismic isolation device which supports an object structure of seismic isolation, and at the same time, reduces simultaneously horizontal and vertical quake of the object structure against an earthquake comprising horizontal and vertical quakes.

For the purpose of protecting various machines and electric facilities installed on a floor in a building or outdoors, there are conventionally disclosed, for example as in Japanese Patent Publications Nos. SHO 60-39831 and HEI 3-74304, floor seismic isolation devices which perform horizontal seismic isolation through combination of restoring devices having a restoring force and a damping force in the horizontal direction with a floor and bearings supporting various machines and electric facilities arranged on the floor.

As shown in FIG. 9, there is available a horizontal seismic isolation device which has a horizontal support mechanism comprising a frictional member 43 placed on a base plate member 42 in place of bearings and a damping device, and provides a horizontal restoring force by means of a securing projection 45 provided on a strut 61 of a floor body 2 and a horizontal spring member 44 supported on a spring fixing member 46 provided on a structural floor 1.

In addition, as shown in FIG. 10, there is available another horizontal floor seismic isolation device, using bearings such as a ball bearing 50 provided on a strut 61 of a floor body 2 as a supporting mechanism, and a conical dish-shaped ball receiving plate 51 as a mechanism imparting only a restoring force.

As shown in FIG. 11, furthermore, there is known a horizontal seismic isolation device which gives a restoring force by providing, between a structural floor 1 and a floor body 2 or an object structure of seismic isolation, a mass formed by making a rubber lamination 62 comprising thin rubber sheets 65 and steel sheets 66 horizontally and alternately laminated and by placing the rubber lamination between an upper base plate 63 and a lower base plate 64.

All these horizontal seismic isolation devices have a high vertical rigidity and are designed to have a low rigidity in the horizontal direction so as to give a natural frequency lower than the prevailing frequency of horizontal seismic quake, therefore reducing only horizontal component of the quake.

However, as is clear from the experience of the South Hyogo Earthquake of Jan. 17, 1995, a direct-below type earthquake produces not only a horizontal component but also a serious vertical component, amplifies vertical quakes, and may cause damages. Any of the foregoing floor seismic isolation devices cannot exert a favorable effect on vertical quake in such an earthquake, and in addition, a vertical seismic force directly acts in the vertical direction, a floor itself bearing various machines and electric facilities installed thereon suffers from a largely amplified vertical quake, i.e., ex-plane quake, and this may damage these machines and facilities.

To bring about a seismic isolation effect also in the vertical direction, therefore, there are available a device, as shown in FIG. 12, in which an inner cylinder 41 and an outer cylinder 40 are provided between a horizontal seismic isolation device and a floor body 2, and a vertical spring member 39 and the like are installed therein, and a device, as shown in FIG. 13, in which, outside the inner cylinder 41 and the outer cylinder 40, a vertical damping member 47 is installed in parallel with the vertical spring member 39 in the device shown in FIG. 12 to further inhibit vertical quake. In FIGS. 12 and 13, components corresponding to those in FIG. 9 are assigned with the same reference numerals, respectively.

There are also available a device, as shown in FIG. 14, in which bearings such as a ball bearing 50 shown in FIG. 10 are provided in a strut 61 for extending a spring shoe 48 to the lower portion, and a vertical spring member 39 is installed between the spring shoe 48 and the floor body 2 to provide the strut 61 vertically movable inside the outer cylinder 40, and a device, as shown in FIG. 15, in which pneumatic springs are arranged in series in the upper portion of the device shown in FIG. 11. In the seismic isolation device shown in FIG. 16, a foundation 59 is provided on the ground 60, an entire rack 55 placed thereon through a horizontal seismic isolating member 56 is horizontally seismic-isolated, and an object structure of seismic isolation is installed in this rack 55 through a vertical seismic isolating member 57. To inhibit rocking quake of the object structure of seismic isolation as a whole, a vertical bearing member 58, which slides vertically to constrain a horizontal deformation, is installed on a side of the rack 55 to serve as a rocking seismic isolating device. The term "rocking quake" mentioned herein means a rotating motion rotating around an axis in a direction at right angles to the axis of displacement of the floor body.

As has been clearly suggested by the South Hyogo Earthquake on Jan. 17, 1995, a direct-below type earthquake gives large vertical seismic quakes in addition to horizontal ones. Vertical seismic insolation is not accomplished by a conventional horizontal seismic isolation device such as those disclosed in Japanese Patent Publications No. SHO 60-39831 and No. HEI 3-74304 and those shown in FIGS. 9, 10 and 11. As these conventional devices are structurally rigid, a vertical quake is transmitted directly from the horizontal seismic isolation device, and the floor structure thereby supported suffers from largely amplified vertical quakes. This may damage the object structure of seismic isolation installed on the floor structure. When the floor structure is largely deformed by the vertical quakes, the horizontal seismic isolation device connected to the floor structure receives a large force, and if broken, the horizontal seismic isolation property is impaired, thus finally resulting in possibility of destruction of the seismic isolation structure and the object structure of seismic isolation.

To reduce vertical seismic quakes, therefore, the vertical seismic shock is alleviated by using a lower vertical rigidity by means of a coil spring or a pneumatic spring as in the devices shown in FIGS. 12 to 15. However, the use of a lower vertical rigidity brings about accordingly a lower horizontal rigidity and a lower rotation rigidity for the horizontal axis. This increases horizontal quakes of the entire floor supported by the seismic isolation device, and leads to promotion of rocking, thus resulting in a largely reduced seismic isolation property. Particularly, the pneumatic spring portion of the structure shown in FIG. 15 may seriously suffer from these problems. While the device shown in FIG. 16 exerts a remarkable effect of preventing horizontal quakes and rocking quakes, it requires a new large-scale rack having a rigidity sufficient to prevent these quakes, resulting in a large-scale structure as a whole and hence a higher cost. It is therefore difficult to install it in a building.

In the case of FIGS. 12 to 14, the weight of the floor structure and the object structure of seismic isolation is supported in a single structure, bearing simultaneously horizontal and vertical seismic load. As a result, the horizontal seismic load acts on the vertical seismic isolation device, and the vertical seismic load act horizontally, thus intervening with the respective original seismic isolation structures. This may prevent the individual seismic isolation capabilities to display full merits thereof.

In FIGS. 12 and 13 for example, a frictional member is used as a horizontal bearing, also serving as a damping member. The frictional force at this point would be the product of the static weight based on gravity multiplied by the frictional coefficient when no earthquake is present. However, when vertical earthquake exerts its force, the bearing load acting vertically comprises, in addition to the static weight based on gravity, the sum of inertia caused by vertical seismic quakes and oscillation of the floor structure, so that the horizontal frictional force varies largely under the effect of vertical quakes. It is probable that the initially anticipated horizontal bearing function and a damping ability from friction cannot be expected. In FIG. 14, the horizontal restoring force is dependent upon the downward component of downward gravity (acceleration) produced on the downward slant of a conical ball receiving dish. If an earthquake contains vertical quakes, therefore, the downward acceleration would largely fluctuates, with large variations of the horizontal restoring force. This may therefore prevent a prescribed horizontal seismic isolation function from displaying full merits thereof.

When a coil spring or an pneumatic spring is used for vertical seismic isolation, furthermore, the bearing load based on gravity and the vertical seismic load are simultaneously supported, resulting in serious vertical deformation of the spring. Vertical rigidity cannot therefore be reduced beyond a certain level, and this poses the problem of limiting the vertical seismic isolation ability.

SUMMARY OF THE INVENTION

An object of the present invention is to substantially eliminate defects or drawbacks encountered in the prior art described above and to provide a seismic isolation device having a compact structure capable of isolating a mechanism supporting a bearing load based on gravity acting vertically and a seismic load from a mechanism supporting a horizontal seismic load, minimizing mutual intervention thereof, and permitting full display of horizontal and vertical seismic isolation ability without using a special rocking preventing mechanism.

This and other objects can be achieved according to the present invention by providing a seismic isolation device comprising:

- a floor body which is arranged on a structural floor and to which an object of seismic isolation is mounted;
- a first restoring means disposed on the structural floor and adapted to impart a horizontal restoring force to the floor body when the floor body is horizontally displaced with respect to the structural floor;
- a first damping means arranged in association with the first restoring means and adapted to impart a horizontal damping force when the floor body is horizontally displaced with respect to the structural floor;
- a first engaging member projecting from the floor body towards the structural floor;
- a second engaging member provided on the first restoring means and sliding while coming into contact with the first engaging member;
- a second restoring means disposed to a lower portion of the floor body and adapted to impart a vertical restoring force when the floor body is vertically displaced with respect to the structural floor;
- a second damping means arranged in association with the second restoring means and adapted to impart a a vertical damping force when the floor body is vertically displaced with respect to the structural floor; and
- a support means for supporting the floor body to be movable in a horizontal direction.

In preferred embodiments of the present invention of the above aspect, the first restoring means comprises a pair of opposing guide mechanisms disposed on the structural floor, a pair of opposing sliding members provided between the guide mechanisms to be slidable only in the opposing direction, an elastic body connecting the paired sliding members and a first stop member adapted to prevent the respective sliding members from coming within a prescribed distance. The first restoring means further comprises a spring means disposed between the sliding members.

The first damping means is provided for the first restoring means so as to be disposed between the sliding members and adapted to change a kinetic energy thereof to a thermal energy to damp a horizontal quake.

The second engaging member is mounted to the sliding members of the first restoring means and comprises a rotary member which slides while being in contact with the first engaging member and a shaft member supporting the rotary member through a bearing. The rotary member has a vertical length longer than a sum of a vertical length of a contact member of the first engaging member in contact with the rotary member and twice a prescribed maximum anticipated vertical displacement previously determined of the floor body, and the rotary member of the second engaging member has an upper end portion disposed at a position higher in level than an upper end of the contact member of the second engaging member with a difference in height over the maximum anticipated vertical displacement of the floor body upon an occurrence of an earthquake and the rotary member has a lower end disposed at a position lower in level than a lower end of the contact member of the upper engaging member with a difference in height over the maximum anticipated vertical displacement of the floor body upon the occurrence of an earthquake.

A contact member having a frictional coefficient lower than that of the first engaging member is provided on a contact surface of the first engaging member contacting the second engaging member, and an elastic member having a rigidity lower than that of the first engaging member is inserted between the contact member having a lower frictional coefficient provided on the contact surface and the first engaging member.

A plurality of the first restoring means and the first damping means may be disposed on the structural floor with respect to the floor body.

A cylindrical member is mounted to the floor body so as to extend towards the structural floor and the second restoring means and the second damping means are accommodated in the cylindrical member.

A plurality of cylindrical members may be also mounted to the floor body.

The support means is provided with a bearing means through which the support means is slidable on the structural floor.

The second restoring means comprises a spiral elastic body and the second damping means is housed in the second restoring means. The floor body is supported by the support means through the cylindrical member. The support means is housed in said cylindrical member.

A vertical natural frequency of the second restoring means relative to a total weight of the floor body and the object of seismic isolation is larger than a horizontal natural frequency of the first restoring means relative to the total weight of the floor body and the object of seismic isolation and wherein a vertical attenuation constant of the second damping means relative to the total weight of the floor body and the object of seismic isolation is larger than a horizontal attenuation constant of the first damping means relative to the total weight of the floor body and the object of seismic isolation.

There may be further disposed a second stop member which constrains mutual relative motion when the vertical relative displacement between the lower end of the cylindrical member housing the spiral elastic body and the upper end of the support means movable in the horizontal direction is smaller than a value of 0 and a vertical distance between the upper end of the support means and the lower end of the cylindrical member upon installation of the second stop member is longer than the prescribed maximum anticipated vertical displacement previously determined for the floor body upon an occurrence of an earthquake.

There may be further disposed a vertical sliding member composed of a material having a frictional coefficient lower than that of either one of the support means and the cylindrical member, which is inserted between an inner wall of the cylindrical member and the support means so as to constrain only a horizontal relative displacement between the support means and the cylindrical member while being in contact with the support means.

In a broader aspect of the present invention, there may be provided a seismic isolation device comprising:

a floor body which is arranged on a structural floor and to which an object of seismic isolation is mounted;

a first seismic isolation means disposed on the structural floor and adapted to impart a horizontal restoring force and a horizontal damping force to the floor body when the floor body is horizontally displaced with respect to the structural floor;

means adapted to limit a vertical movement of the floor body with respect to the structural floor in consideration of a maximum anticipated vertical displacement of the floor body upon an occurrence of an earthquake;

a second seismic isolation means disposed to the floor body and adapted to impart a vertical restoring force and a vertical damping force when the floor body is vertically displaced with respect to the structural floor; and a support means for supporting the floor body to be movable in a horizontal direction.

It is to be noted that the above preferred embodiments may be applied to this seismic isolation devide.

According to the seismic isolation device of the present invention described above, the following functions and effects will be attained.

According to the seismic isolation device in a main aspect, when a direct-below type earthquake occurs and horizontal and vertical motions are transmitted to the structural floor, the seismic isolation devices arranged in various directions start acting. At this point, most of the horizontal inertia caused by horizontal quake of the floor body acts on the first restoring means and the first damping means, not vertically on the second restoring means or the second damping means, thus reducing the horizontal quake. At the engagement portion of the first restoring means and the floor body, the upper engaging member and the lower engaging member are horizontally constrained, not vertically, so that the vertical motion of the floor body or the seismic quake from the structural floor is not transmitted. The vertical quake of the floor body or the vertical motion caused by rocking vibration acts on the second restoring means and the second damping means, thus reducing these vertical motions. Therefore, the first restoring means is not affected almost at all by the vertical force from the floor body or the structural floor. Since the vertical seismic isolation device is not subjected almost at all to the effect of the horizontal force from the floor body or the structural floor, the individual seismic isolation devices can fully attain their original functions and improve the three-dimensional seismic isolating effect.

In preferred aspects of the seismic isolation device of the present invention, when a vertical seismic motion causes the second restoring means and the second damping means acting on the vertical motion to operate, the upper engaging member never run across or come off the rotary member, and never hit the first restoring means or the sliding member. It is therefore possible to obtain a horizontal restoring force without fail and to improve reliability of the seismic isolation effect.

The contact member having a low frictional coefficient is used for the contact surface of the upper engaging member with the lower engaging member. This reduces the frictional force, minimizes the imbalanced vertical force of the upper and the lower engaging members, and makes it harder for a detrimental vibration such as rocking vibration of the floor body to occur. It is thus possible to improve the three-dimensional seismic isolation effect.

Furthermore, the upper engaging member can maintain a uniform contact surface with the lower engaging member. It is therefore possible to ensure vertical sliding because fluctuation of the vertical frictional force caused by a local contact of the upper engaging member is reduced. An excessive flexural moment does not act on the lower engaging member, with no damage to the surface of the lower engaging member. Improvement of reliability of the three-dimensional seismic isolation effect can thus be achieved.

The second damping means is provided in the inside of the second restoring means, thus permitting improvement of the arrangement efficiency and downsizing of the seismic isolation device itself. Achievement of a more compact seismic isolation device itself allows reduction of the floor body height as a whole. This can improve inhibition of rocking vibration of the entire floor body.

Because the vertical natural frequency is set at a value higher than the vertical one, a high rigidity is available in the vertical direction, with a higher rigidity against rocking.

There is adopted a vertical damping constant larger than the horizontal damping constant. Even when a vertical seismic quake is larger than the horizontal one, therefore, it is possible to prevent the floor body from excessively displacing in the vertical direction. Even upon occurrence of rocking vibration, the vertical relative displacement caused by rocking vibration can be damped with the second damping means, thus inhibiting rocking vibration. Accordingly, even upon occurrence of an excessive vertical displacement of the floor body or rocking vibration, it is possible to inhibit a vertical displacement or rotational displacement caused by rocking, thus permitting prevention of breakage of the second restoring means without causing an excessive deformation thereof, and to efficiently reduce vertical quake and rocking vibration and improve the three-dimensional seismic isolation effect.

Still furthermore, even when the device is lifted up for maintenance purposes or the floor body displaces in the vertical direction as a result of a very serious vertical earthquake, the support means can be prevented from coming off the cylinder, and it is possible to always keep integrity of the cylinder, the second restoring device, the second damping device and the support means, thus permitting improvement of reliability of the seismic isolation effect. There occurs only small frictional force between the inner wall of the cylinder and the outer wall of the support means. This leads to a smooth vertical motion of the support means, and it is possible to reduce probability that frictional force causes an imbalanced vibration of the floor body. It is therefore possible to improve the seismic isolation effect particularly in the vertical direction.

The above advantageous functions and effects can be achieved more effectively by arranging a plurality of seismic isolation devices in proper arrangement.

The nature and further characteristic features of the present invention will be made more clear from the following descriptions with reference to the accompanying drawings.

DESCRIPTION OF THE PREFERRED EMBODIMENTS

Figure 1A:
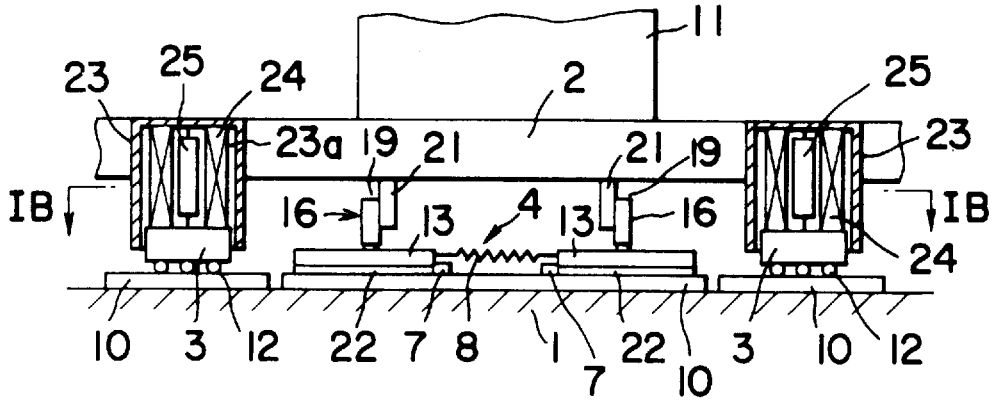
FIG. 1A is a side view illustrating a first embodiment of the seismic isolation device of the present invention and FIG. 1B is a sectional view taken along the line IB—IB in FIG. 1A.

A first embodiment of the seismic isolation device of the present invention will be described hereunder with reference to FIGS. 1 and 2. In the seismic isolation device of the first embodiment, as shown in FIG. 1A, a cylinder 23 for housing a vertical seismic isolation device 23*a* is secured to a floor body 2, and the floor body 2 and the cylinder 23 are supported by a travel supporting mechanism 3 which is supporting means sliding horizontally with a low friction through a vertical elastic body 24, which serve as a vertical seismic isolation device 23*a*, i.e., vertical restoring means and which is arranged in parallel and also through a vertical damping member 25 serving as vertical damping means. The travel supporting mechanism 3 has a bearing such as a metallic ball bearing 12 in the lower portion thereof and causes a sliding plate 10 fixed to a structural floor 1 to freely slide. That is, the restoring force device 4 is disposed on the structural floor 1 through the sliding plate 10. The cylinder 23 has a gap with the travel supporting mechanism 3 to such extent that it does not come into horizontal contact with the latter. The cylinder 23, partially covering the travel supporting mechanism 3 to restrict it so as not to leave in the horizontal direction with respect to the cylinder 23 and causes the same to travel integrally. Relative displacement of the cylinder 23 and the travel supporting mechanism 3 is allowed in the vertical direction.

On the other hand, the floor body 2 and a restoring force device 4 serving as force restoring means are in contact with an upper engaging member 21 fixed to a lower portion of the floor body 2 and with a lower engaging member 16 on the restoring force device 4 side. This portion is basically the same as in the horizontal seismic isolation device proposed in Japanese Patent Publication No. HEI 3-74304.

Figure 1B:
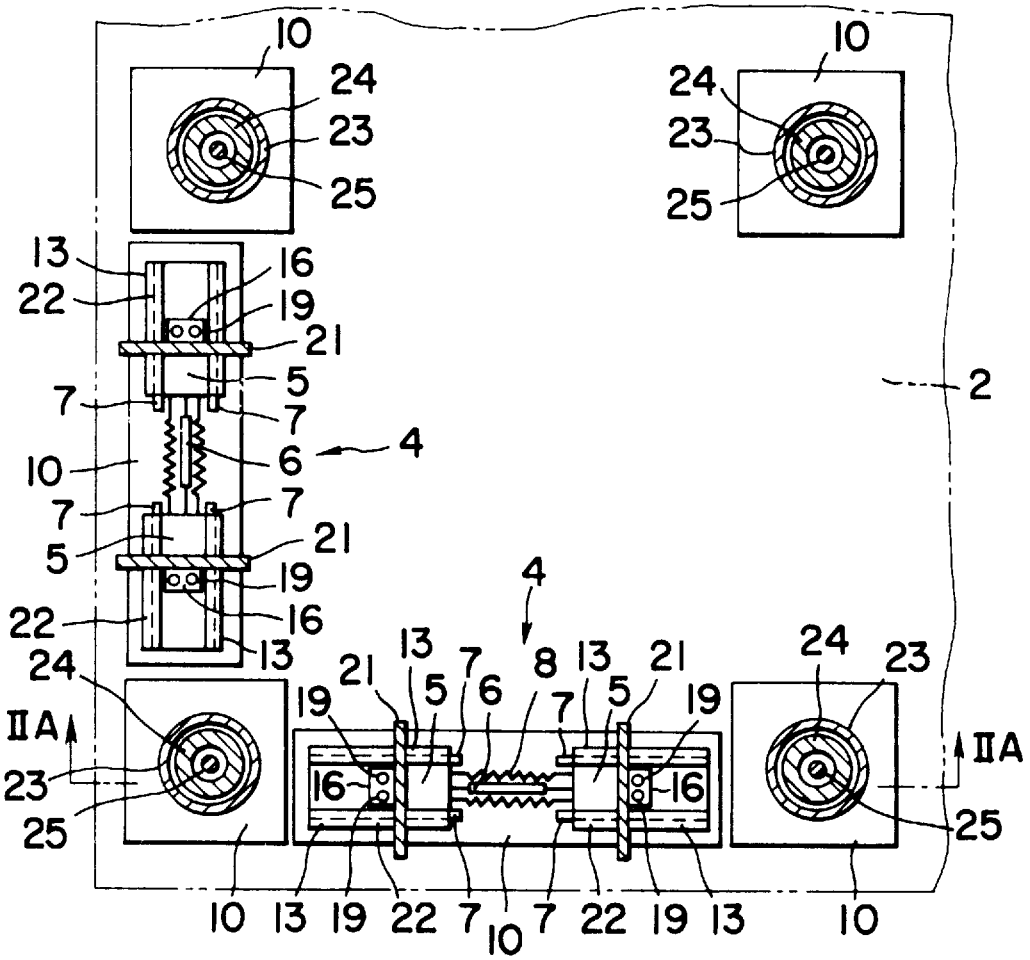

Arrangement of the restoring force device 4, the cylinder 23 and the sliding plate 10 is as shown in FIG. 1B.

The restoring force device 4 comprises a sliding member 5 sliding on the sliding plate 10, a stopper 7, a tension spring 8, a guide mechanism 13 and a guide member 22. As damping means in the horizontal direction, a horizontal damping device 6 is provided. This damping means for the horizontal direction is assembled in the restoring force device so as to be disposed between the sliding members 5 thereof and secured thereto. The sliding member 5 is slidably held between the guide member 22 provided on the sliding plate 10 and the guide mechanism 13 provided on an upper portion of this guide member 22, and further engaged with the guide mechanism 13 to prevent the same from coming off.

In a preferred example, a plurality of the restoring force devices 4 and the cylinders 23 may be arranged substantially on the same horizontal level. For example, when the floor body 2 is constructed to have a rectangular shape, it will be desired to arrange the cylinders 23 to portions near the four corner portions and the restoring force devices 4 between the cylinders 23, respectively.

Figure 2A:
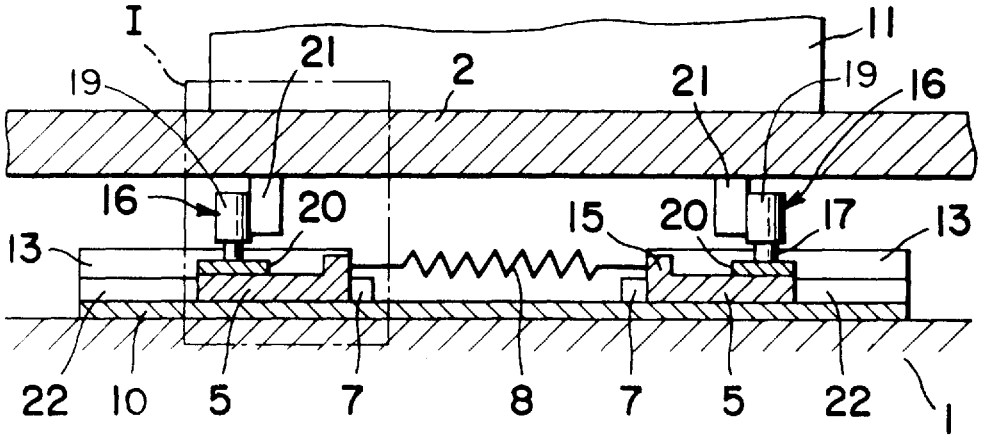
FIG. 2 is a sectional view taken along the line IIA—IIA in FIG. 1A.
FIG. 2B is an enlarged longitudinal sectional view illustrating the portion I in FIG. 2A.
FIG. 2C is a sectional view taken along the lone IIC—IIC in FIG. 2B.
Figure 2B:
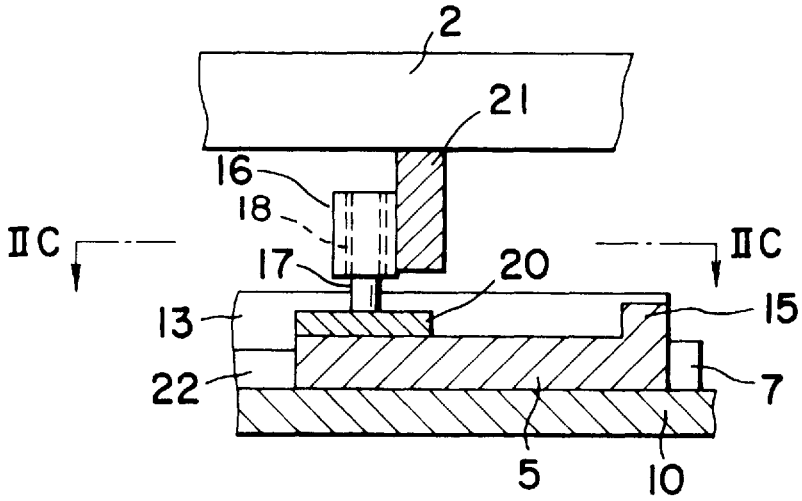
Figure 2C:
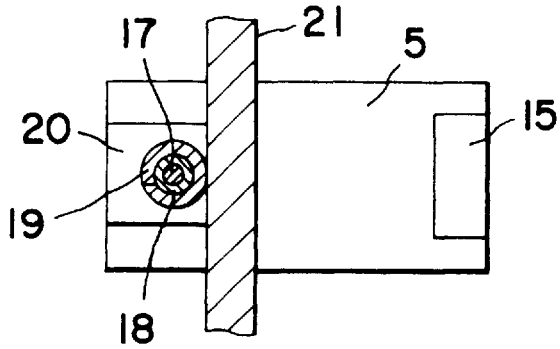

With reference to FIGS. 2A to 2C, the tension spring 8 is provided between projections 15. The stopper 7 is provided to limit horizontal sliding of the sliding member 5, and a right and a left sliding members 5 and 5 shown in FIG. 2A are prevented from moving inward by the presence of the respective stoppers 7 and 7.

The lower engaging member 16 has a roller 19 serving as a rotary member coming into contact with the upper engaging member 21 and a shaft 17. The shaft 17 is provided on a shaft base 20 which secures the shaft 17. The shaft base 20 is fixed to the sliding member 5. The roller 19 transmits the restoring force to the right and the left, and for a motion in a direction perpendicular to the floor 2 in the drawing, the roller 19 rotates to achieve absence of mutual constraint. As shown in FIG. 2C, the roller 19 coming into contact with the upper engaging member 21 is supported by the shaft 17 through an inner bearing 18.

According to the first embodiment of the seismic isolation device of the present invention having the structure described above, for example when a serious direct-below type earthquake takes place and horizontal and vertical seismic quakes are transmitted to the structural floor 1, the restoring force device 4 and the vertical seismic isolation device 23*a* begin acting. At this point, most of horizontal inertia caused by horizontal quake of the floor body 2 acts on the restoring force device 4, not on the vertical seismic isolation device 23*a*, thus reducing horizontal quake. At the engagement portion of the restoring force device 4 and the floor body 2, the upper engaging member 21 and the lower engaging member 16 are horizontally constrained, but not vertically, so that the vertical motion of the floor body 2 or the seismic quakes from the structural floor 1 are not transmitted.

The restoring force device 4 will function as follows more in detail.

In the restoring device 4, if the floor body 2 quakes to the right, for example, in FIG. 1B, the right and the left upper engaging members 21 and 21 (shown in the lower part of the drawing) provided on the floor body 2 also displace to the right. At this point, while the left sliding member 5 cannot move to the right beyond the shown position under the effect of the left stopper 7, the right sliding member 5 moves in response to the oscillation of the floor body 2 while the right upper engaging member 21 is in contact with the roller 19 of the lower engaging member 16. Accordingly, the tension spring 8 elongates and a restoring force acts to bring the right sliding member 5 back to the left. For a left quakes, actions are reverse. When the floor body 2 quakes to the right and the left, the horizontal damping device 6 damps the quake by converting energy of motion into thermal energy.

On the other hand, in the restoring force device 4 shown in the left part of the drawing, when a right/left quake is caused, a right/left quake is also caused by the upper engaging members 21 and 21 in a direction different from the sliding direction of the sliding members 5 and 5 of the restoring force device 4 shown in the left part. Sliding does not therefore occur, and the rollers 19 and 19 slide while being in contact with the upper engaging member 21.

Furthermore, a vertical quake of the floor body or a vertical motion caused by rocking acts on the vertical seismic isolation device 23*a*, thus reducing these vertical moves. Therefore, the restoring force device receives almost no vertical force from the floor body 2 or the structural floor 1, and the vertical seismic isolation device 23*a* receives almost no horizontal force from the floor body 2 or the structural floor 1. The individual seismic isolation devices perform their respective original functions and can thus effectively provide a prescribed seismic isolation effect.

Figure 3A:
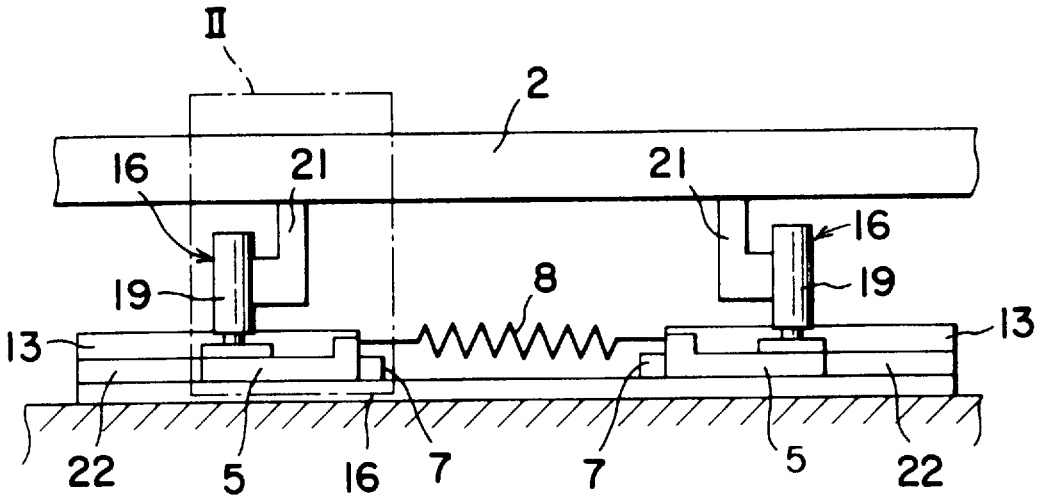
FIG. 3A is a side view illustrating a second embodiment of the seismic isolation device of the present invention and FIG. 3B is an enlarged side view illustrating the portion II in FIG. 3A.

A second embodiment of the seismic isolation device of the present invention will be described hereunder with reference to FIGS. 3A and 3B, in which like reference numerals are added to elements or members corresponding to those shown in FIG. 1A and 1B and description thereof is omitted here.

Figure 3B:
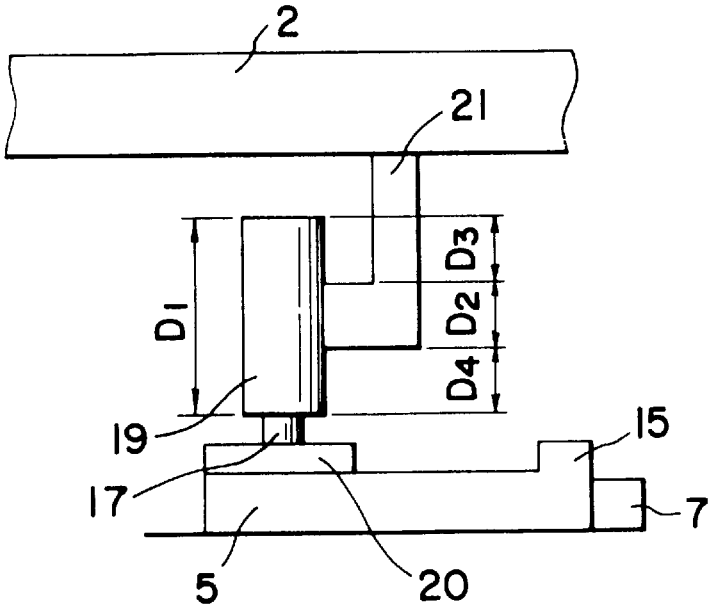

FIG. 3B represents a state in which there is achieved a balance between the spring force of the vertical seismic isolation device 23*a* shown in FIG. 1A and the weight of the floor body 2 and the object structure of seismic isolation 11. In FIG. 3B, the vertical length (D1 in FIG. 3B) of the roller 19 forming the lower engaging member in contact and engaging with the upper engaging member 21 is longer than the sum of the vertical width (D2 in FIG. 3B) of the contact member 26 of the upper engaging member 21 in contact with the roller 19 and twice the maximum anticipated vertical relative displacement (this displacement hereinafter is simply referred to as "DO") of the floor body. The reason is that, in view of the movable range of the floor body, it is necessary to ensure a maximum anticipated vertical relative displacement. When the width is smaller than this maximum anticipated relative displacement, the descent of the floor body may result in collision with the sliding member 5 of the restoring force device 4, and the ascent thereof may cause disengagement between the roller 19 and the upper engaging member 21.

In this state, furthermore, the length of the roller upper portion (D3 in FIG. 3B) should be longer than the maximum anticipated vertical relative displacement DO, and the length of the roller lower portion (D4 in FIG. 3B) should longer than the maximum anticipated vertical relative displacement DO. That is, the conditions will be expressed as follows:

$$D3,\ D4>D0$$

$$D1=D2+D3+D4$$

According to this embodiment, the vertical seismic isolation device 23*a* is started by vertical seismic motion, and when the floor body 2 displaces in the vertical direction, the upper engaging member 21 moving integrally with the floor body 2 vertically displaces in the axial direction of the roller 19 while being in contact with the roller 19. At this time, if the roller length is set to the maximum length of relative displacement of the contact member 26, the contact member 26 never goes over or comes off the roller 19 and never hits the base 20 of the restoring force device 4 or the sliding member 5. It is therefore possible to obtain horizontal restoring force function without fail, thus ensuring horizontal seismic isolation effect.

A third embodiment of the seismic isolation device of the present invention will be described hereunder with reference to FIGS. 4A and 4B.

Figure 4A:
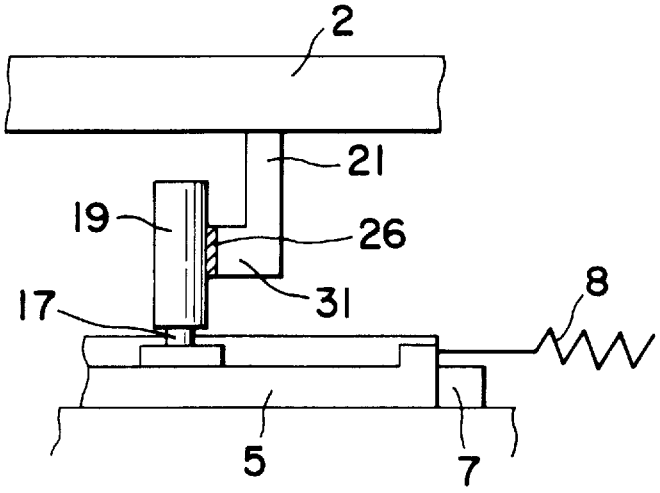
FIG. 4A is a side view illustrating an arrangement of a lower engaging member on the restoring device side and an upper engaging member on the floor body side in a third embodiment of the seismic isolation device of the present invention and FIG. 4B is a side view illustrating the conceptual motion of the lower engaging member on the restoring device side and the upper engaging member on the floor body side relative to the floor body when the floor body displaces horizontally and vertically upon occurrence of an earthquake.
Figure 4B:
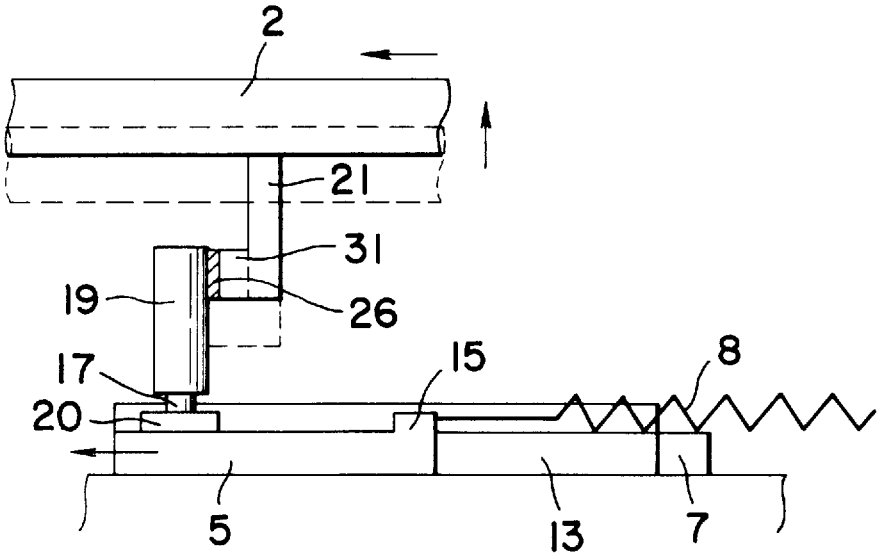

In the upper engaging member 21, as shown in FIG. 4A, a contact member 26 having a frictional coefficient sufficiently smaller than that of a metal sheet is provided at the portion in contact with a roller 19 forming a lower engaging member. The contact member 26 comprises more specifically a teflon sheet. There is however no limitation on the material thereof so far as the frictional coefficient is smaller than that of the structural material of the upper engaging member 21, which improves the sliding property with the roller 19. The contact member 26 is provided at the end of a beam 31 projecting from the upper engaging member 21.

According to this embodiment, the roller 19 is in contact with the contact member 26 having a sufficiently small frictional coefficient. As shown in FIG. 4B, therefore, the floor body 2 horizontally displaces in a direction of pressing the roller 19, and a pressing force acts between the roller 19 and the upper engaging member 21, i.e., the contact member 26. In addition, when the floor body 2 vertically displaces under the effect of a vertical seismic motion, a frictional force proportional to the pressing force and the frictional coefficient is produced between the roller 19 and the contact member 26 in the direction of the axis 17 of the roller 19, i.e., in the vertical direction. This frictional force is produced only in the roller 19 of the restoring force device 4 and the upper engaging member 21 in the direction of displacement of the floor body 2. No frictional force is produced between the roller 19 of the restoring force device 4 and the upper engaging member 21 on the opposite side, far apart from each other. The floor body 2 therefore receives a frictional force not in balance in the vertical direction at the engagement portion of the restoring force device 4, so that the floor body 2 may cause imbalanced vibration or rocking vibration. In the present invention, therefore, a low-friction material is used for the contact member 26, resulting in a very small frictional force, sufficiently reducing the force imbalanced in the vertical direction at engagement portions. Detrimental vibration such as rocking vibration thus becomes harder to occur in the floor body 2. The seismic isolation device can thus fully attain the excellent three-dimensional seismic isolation ability thereof.

Then, the imbalanced vibration will be discussed. When a plurality of upper engaging members 21 engage with the floor body 2 which is a seismic isolation floor as shown in FIG. 4A, the floor surface level should preferably quake vertically in response to vertical quake of the floor body upon occurrence of an earthquake. However, vertical frictional force between these plurality of upper engaging members 21 and the roller 19 only rarely takes a constant value. When the floor body 2 vertically moves while quaking in the horizontal direction, portions in contact and not in contact occur between the upper engaging members 21 and the roller 19, depending upon horizontal displacement. At this point, because the frictional force in the vertical direction is produced by the contact between the upper engaging member 21 and the roller 19, the acting position of frictional force deviates from the position of the center of gravity of the floor body 2. The entire floor of the floor body 2 cannot therefore maintain a horizontal plane, but quakes while producing torsion. This is called an imbalanced vibration. For this reason, it is desired that the frictional force between the upper engaging member 21 and the roller 19 is to be as possible as small.

The rocking motion is a rotating motion around an axis in a direction at right angles to the axis of displacement of the floor body 2.

A fourth embodiment of the seismic isolation device of the present invention will be described hereunder with reference to FIGS. 5A and 5B.

Figure 5A:
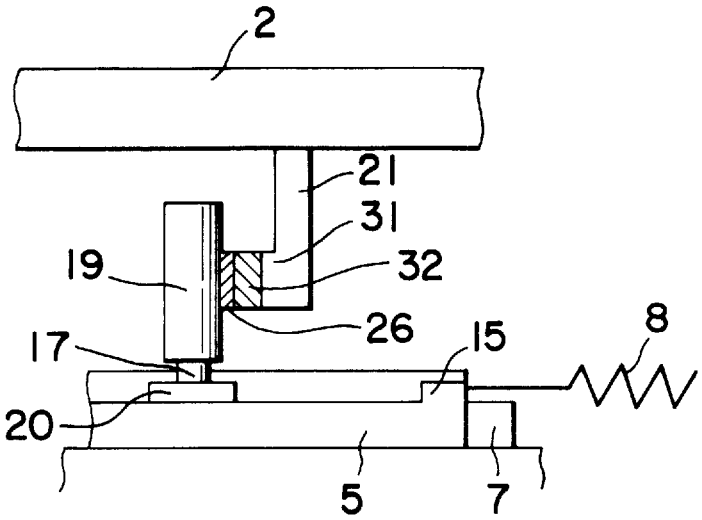
FIG. 5A is a side view illustrating an arrangement of a lower engaging member on the restoring device side and an upper engaging member on the floor body side in a fourth embodiment of the seismic isolation device of the present invention and FIG. 5B is a side view illustrating the conceptual motion of the lower engaging member on the restoring device side and the upper engaging member on the floor body side relative to the floor body when the floor body displaces horizontally and vertically upon occurrence of an earthquake.

In this embodiment, as shown in FIG. 5A, an elastic member 32 made of a material having a soft elasticity such as rubber is provided between a contact member of an upper engaging member 21 in contact with a roller 19 forming a lower engaging member and a beam 31.

Figure 5B:
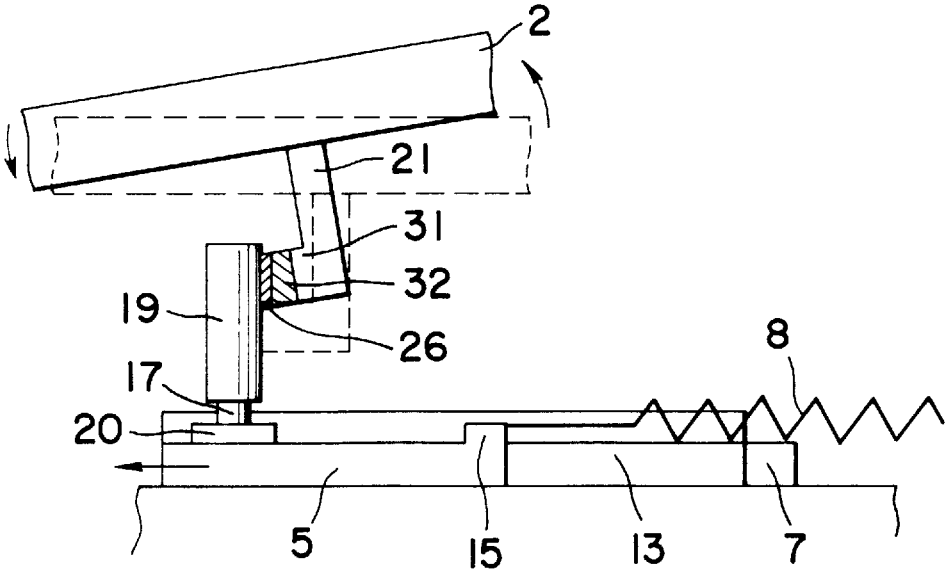

According to this embodiment, as shown in FIG. 5B, when the floor body 2 horizontally displaces in a direction of pressing the roller 19 and inclines under the effect of rocking vibration, a pressing force and a flexural moment act on the roller 19 at the portion of the beam 31 by the action of the upper engaging member 21. When a vertical seismic quake causes the floor body 2 to displace in the vertical direction, a frictional force proportional to the pressing force and the frictional coefficient is produced in the roller axial direction, i.e., in the vertical direction, between the roller 19 and the contact member 26. Particularly, since the upper engaging member 21 and the contact member are rather rigid, the roller 19 receives directly the moment of the floor body 2 and may be damaged therefrom. At the same time, pressing pressure of the contact member 26 against the roller 19 varies between positions in the vertical direction, and the resultant high local pressure may damage the sliding surface and the vertical sliding function may be impaired. In such a state, not only the horizontal seismic isolating ability, but the vertical one, may be reduced. To solve this problem, an elastic member 32 made of a material having a soft elasticity such as rubber is attached between the contact member 26 and the upper engaging member 21. Then, even when the pressing surfaces of the contact member 26 and the upper engaging member 21 inclines relative to the roller 19 axis as a result of rotational displacement of the floor body 2, the elastic member 32 deflects under non-uniform compressive force, alleviating a locally excessive pressing force of the contact member against the roller 19, and further, the contact member 26 can maintain a uniform contact surface with the roller 19. It is therefore possible to avoid local damage of the contact member 26 caused by the contact and to expect smooth vertical sliding because vertical fluctuations of frictional force become smaller. An excessive flexural moment is never exerted on the roller 19, thus eliminating the risk of damages to the roller 19 surface or the shaft 17.

Consequently, the seismic isolation device of this embodiment can fully attain its excellent three-dimensional seismic isolating ability.

A fifth embodiment of the seismic isolation device of the present invention will be described hereunder with reference to FIG. 6.

In the fifth embodiment, a vertical elastic body 24 giving a vertical restoring force to a floor body 2 in a vertical seismic isolation device 23*a* and a vertical damping member 25 such as an oil damper giving a vertical damping force are arranged in parallel, and a vertical damping member 25 is attached inside the structure of the vertical elastic body 24. The force of the vertical elastic body 24 and the vertical damping device 25 is transmitted by a cylindrical upper fixing plate 33 to the floor body. The cylindrical upper fixing plate 33 is a supporting structure which transmits the weight of the floor body 2 and the object structure of the seismic isolation 11 to the vertical elastic body 24.

The vertical natural frequency of the vertical seismic isolation device 23*a* relative to the floor body 2 and the object structure of the seismic isolation 11 is larger than the horizontal natural frequency of the restoring force device 4 relative to the floor body 2 and the object structure of the seismic isolation 11, which acts in the horizontal direction. For example, the horizontal natural frequency is usually set to a value within a range of from 0.2 to 0.5 Hz, whereas the vertical natural frequency is set within a range of from 1 to 1.6 Hz.

The vertical damping constant of the floor body 2 and the object structure of seismic isolation 11 as a whole, which is determined by the vertical damping member 25, is larger than the horizontal damping constant of the damping device installed in the restoring force device 4 acting horizontally relative to the floor body 2 and the object structure of the seismic isolation as a whole. For example, the horizontal damping constant is often set within a range of from about 0.2 to 0.3, whereas the vertical damping constant is set to a value larger than it.

According to this embodiment, the vertical elastic body 24 and the vertical damping member 25 are installed in parallel, and the vertical damping member 25 is installed in the structure of the vertical elastic body 24, requiring no special space for the vertical damping member. It is therefore possible to reduce the horizontal section and vertical seismic isolation device 23*a*, and to provide a more compact device as a whole. Since a small height is realized, rocking vibration of the entire floor body 2 can also be inhibited.

The vertical natural frequency is set at a higher value than the horizontal one, leading to a high rigidity of the vertical elastic body 24. The deflection of the vertical elastic body 24 caused by the gravity is therefore small. The vertical natural frequency is set to a value smaller than the vertical seismic prevailing frequency, leading to a small relative displacement varying with the vertical seismic quake. Because vertical rigidity is increased, resulting in a larger rigidity against rocking, thus making it possible to reduce rotational displacement caused by rocking.

As the vertical damping constant is larger than the horizontal damping coefficient, it is possible to prevent the floor body from excessively displaying in the vertical direction even when a vertical seismic quake is larger than a horizontal one. Even upon production of rocking vibration, it is possible to reduce a vertical displacement of the vertical seismic isolation device resulting from rocking vibration, and thus inhibiting rocking vibration with the large damping force thereof.

According to the present invention, as is clear from the above description, it is possible, even when an excessive vertical displacement or a rocking vibration is caused by an earthquake, to inhibit a rotational displacement resulting from a vertical displacement or rocking. It is therefore possible to prevent the vertical elastic body 24 from being excessively deformed or damaged and effectively reduce a vertical quake or rocking vibration. The seismic device of this embodiment can thus provide an excellent three-dimensional seismic isolating ability.

A sixth embodiment of the seismic isolation device of the present invention will be described hereunder with reference to FIGS. 7A and 7B.

Figure 7A:
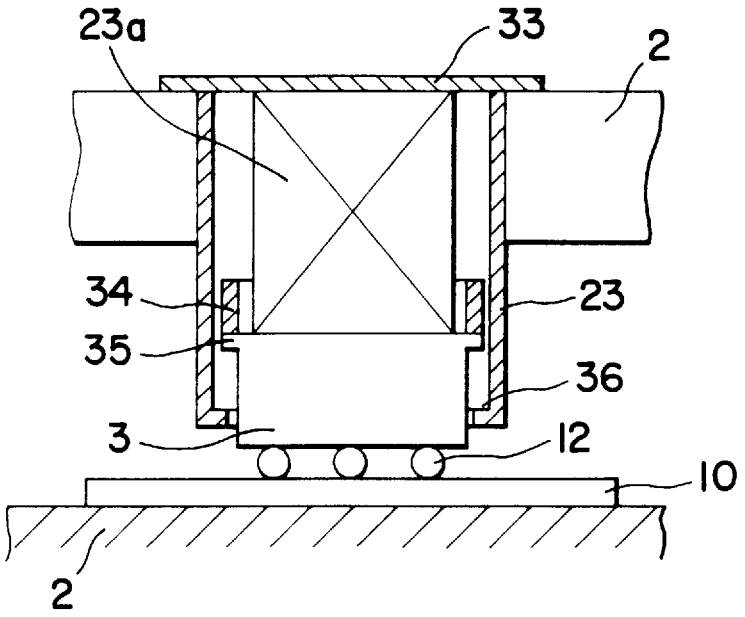
FIG. 7A is a side view illustrating a sixth embodiment of the seismic isolation device of the present invention with a partial longitudinal sectional interior view of the vertical seismic isolation device and FIG. 7B is a side view illustrating the positional relationship between the floor body, the vertical seismic isolation device and the travel supporting mechanism when the floor body displaces vertically.

In the sixth embodiment, as shown in FIG. 7A, the lower end of the cylinder 23 has an inwardly directed projection 36, serving as a stop member, having a gap so as not to impair vertical move of the travel supporting mechanism 3 and the cylinder 23. An outwardly directed travel supporting mechanism projection 35 serving as a stop member so as not to impair vertical move relative to the cylinder 23 is provided at the upper end of the travel supporting mechanism 3. The length of the space between these projections 35 and 36, the lower surface of the cylindrical projection 36 and the upper surface of the sliding plate 10 is longer than the maximum anticipated relative displacement of the floor body 2 upon occurrence of an earthquake. A travel supporter upper cylinder 34 is provided on the upper part of the travel supporting mechanism upper projection 35 so that the vertical seismic isolation device keeps a prescribed position thereof even upon occurrence of a horizontal displacement.

According to this embodiment, a gap is provided so that, even when an earthquake causes the floor body to quake vertically and the cylinder 23 and the travel supporting mechanism 3 move relatively, this move is not prevented. The vertical motion is not therefore impaired but is smooth, and the seismic isolation device 23*a* can fully attain the vertical seismic isolating ability thereof. When the floor body 2 displaces horizontally, the inner wall of the cylinder 23 and the cylindrical projection 36 push the outer wall of the travel supporting mechanism projection 35 and the outer wall of the travel supporting mechanism 3, transmit the force thereto, and the travel supporting mechanism 3 slides in the horizontal direction. Since sliding friction of the travel supporting mechanism 3 is sufficiently small because of the roller friction of the ball 12, and the pressing force acting between the cylinder 23 and the travel supporting mechanism 3 is small, this force does not generate such a vertical friction force as to impair mutual vertical motion, and allows mutual relative vertical motion while being in contact with each other.

Figure 6:
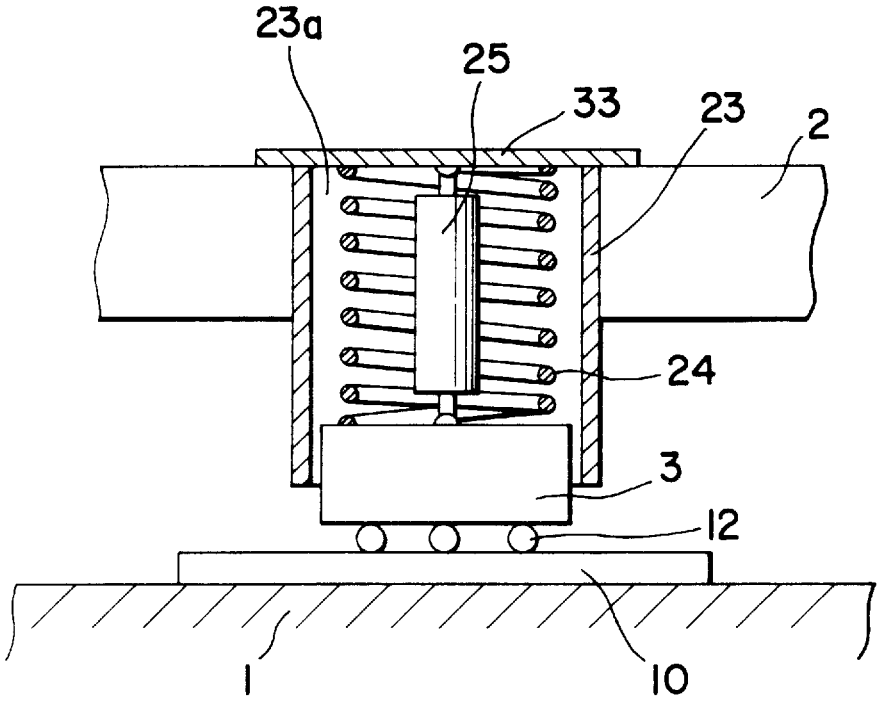
FIG. 6 is a side view illustrating a fifth embodiment of the seismic isolation device of the present invention with a partial longitudinal sectional view.
Figure 7B:
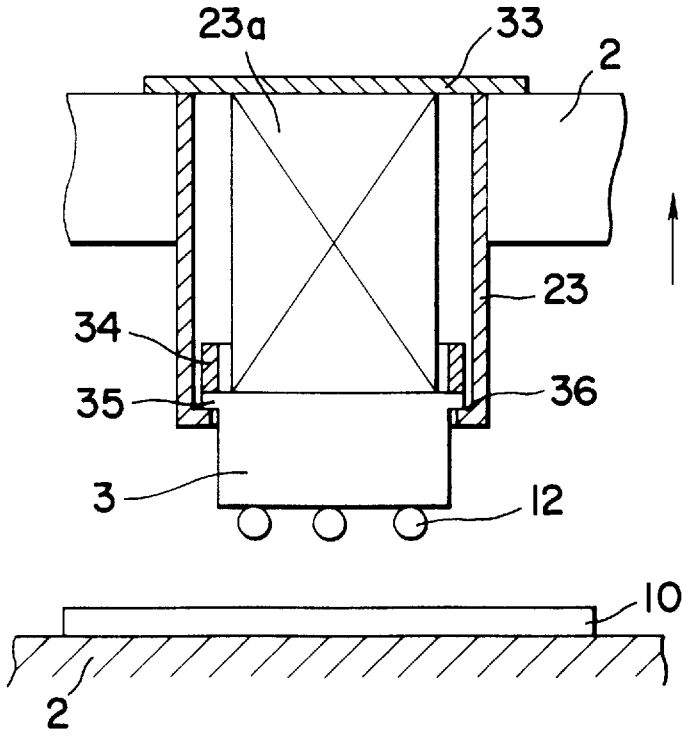

However when the seismic isolation device is lifted up for maintenance purposes, or the floor body 2 largely displaces in the vertical direction as a result of a very serious vertical earthquake, as shown in FIG. 7B, and the floor body exceeds the upper surface of the travel supporting mechanism 3, with the structure shown in FIG. 6, the travel supporting mechanism 3 shifts outside or come off the cylinder 23, and returns no more to the original position thereof. In such a case, not only the vertical seismic isolation device 23*e* or the travel supporting mechanism 3 is broken, but also the vertical supporting mechanism 3 successively loses the vertical supporting function, and the floor body 2 falls down, which may damage the restoring force device 4. Finally, the three-dimensional seismic isolating ability may be lost, resulting in breakage of the object structure of the seismic isolation as well as even breakage of the structures surrounding the seismic isolation device.

In this embodiment, even when the seismic isolation device is lifted up, or the floor body 2 largely displaces vertically and comes off the upper surface of the travel supporting mechanism 3, the cylindrical projection 36 and the travel supporting mechanism projection 35 mutually serve as stoppers in the vertical direction in the state of a relative displacement of 0 and prevent the travel supporting mechanism 3 from coming off the cylinder 23, and these projections 36 and 35 also serves to always keep the cylinder 3, the vertical seismic isolation device 23*a* and the travel supporting mechanism in an integral state and to maintain a constant seismic isolating ability under any condition.

According to this embodiment, therefore, the vertical seismic isolating ability, the vertical supporting function and the horizontal sliding function, i.e., the earthquake shielding function are never lost. This eliminates the risk of breakage of the seismic isolation device or the object structure of seismic isolation 11, thus attaining an excellent three-dimensional seismic isolating ability.

A seventh embodiment of the seismic isolation device of the present invention will be described hereunder with with reference to FIG. 8.

Figure 8:
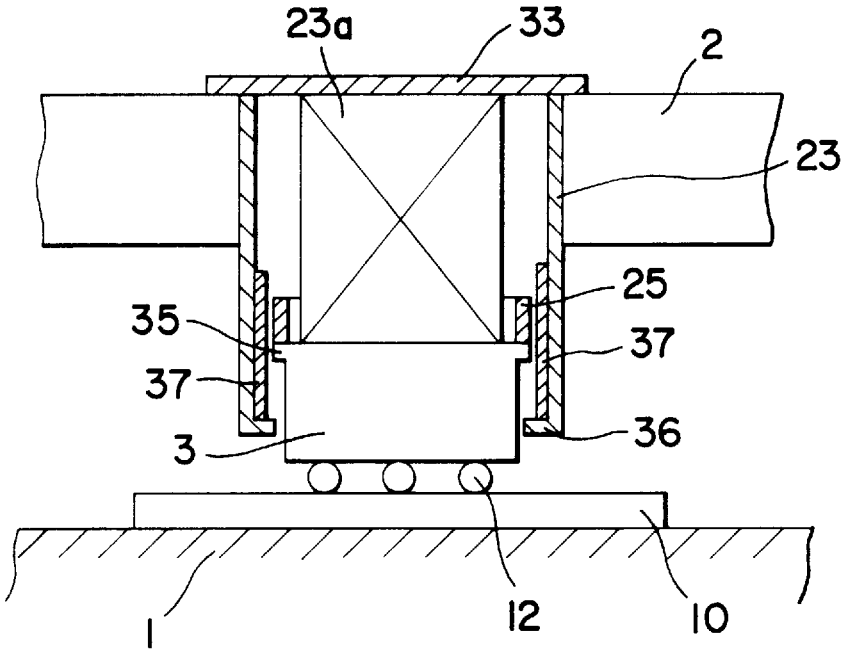
FIG. 8 is a side view illustrating a seventh embodiment of the seismic isolation device of the present invention with a partial longitudinal sectional view.
Figure 9:
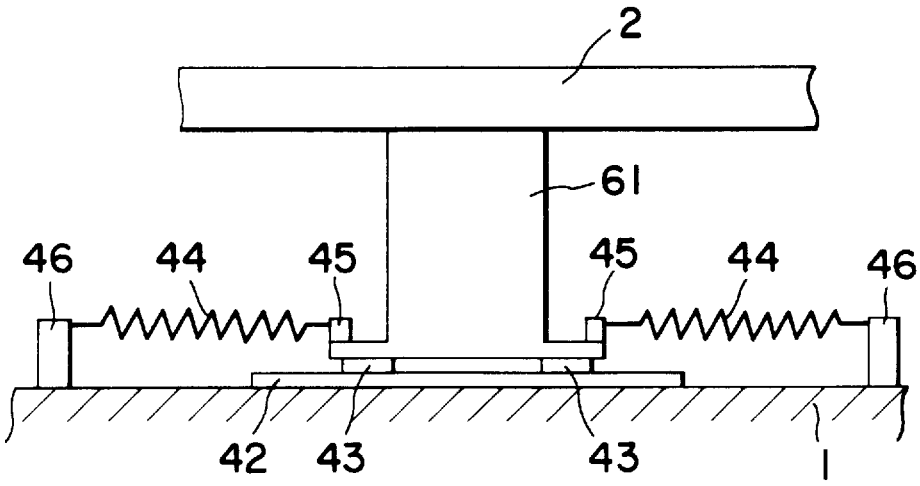
FIG. 9 PRIOR ART
FIG. 9 is a configuration diagram illustrating one example of a conventional seismic isolation device.
Figure 10:
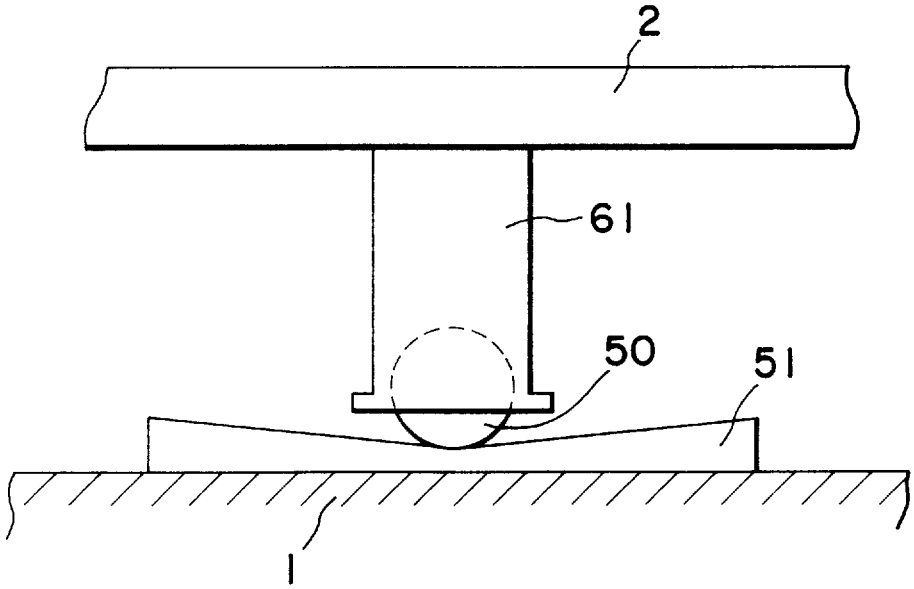
FIG. 10 PRIOR ART
FIG. 10 is a configuration diagram illustrating another example of a conventional seismic isolation device.
Figure 11:
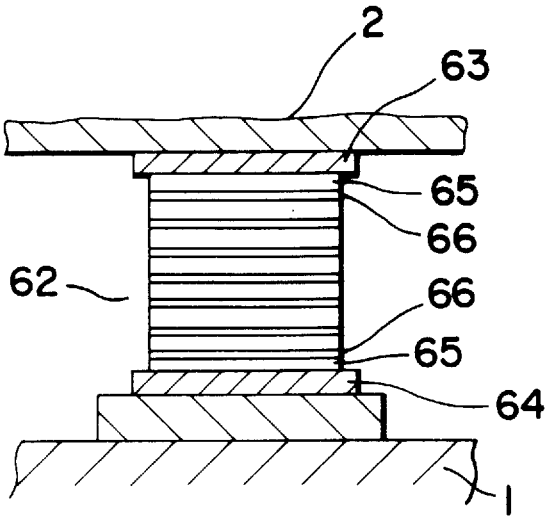
FIG. 11 PRIOR ART
FIG. 11 a configuration diagram illustrating a further example of a conventional seismic isolation device.
Figure 12:
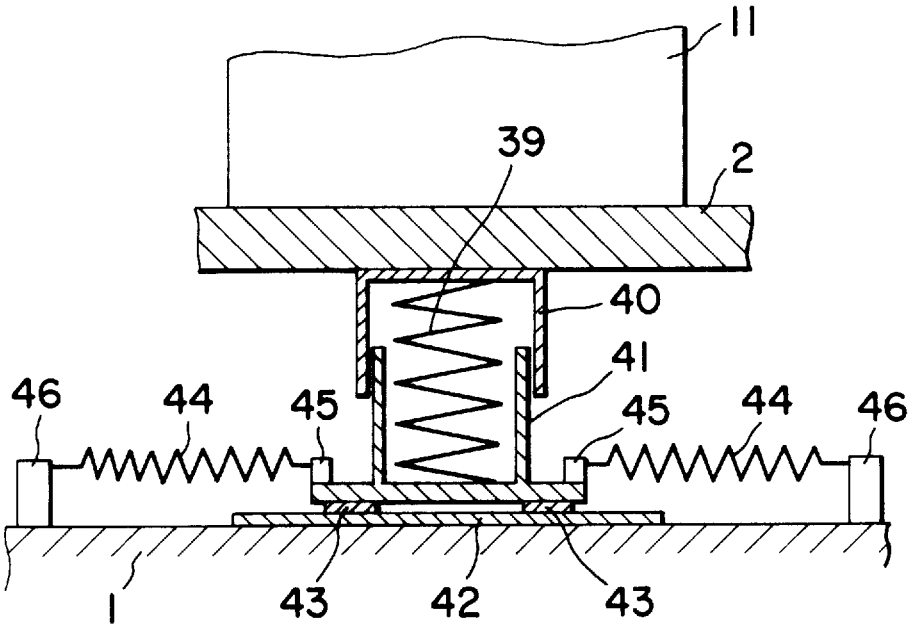
FIG. 12 PRIOR ART
FIG. 12 is a configuration diagram illustrating a still further example of a conventional seismic isolation device.
Figure 13:
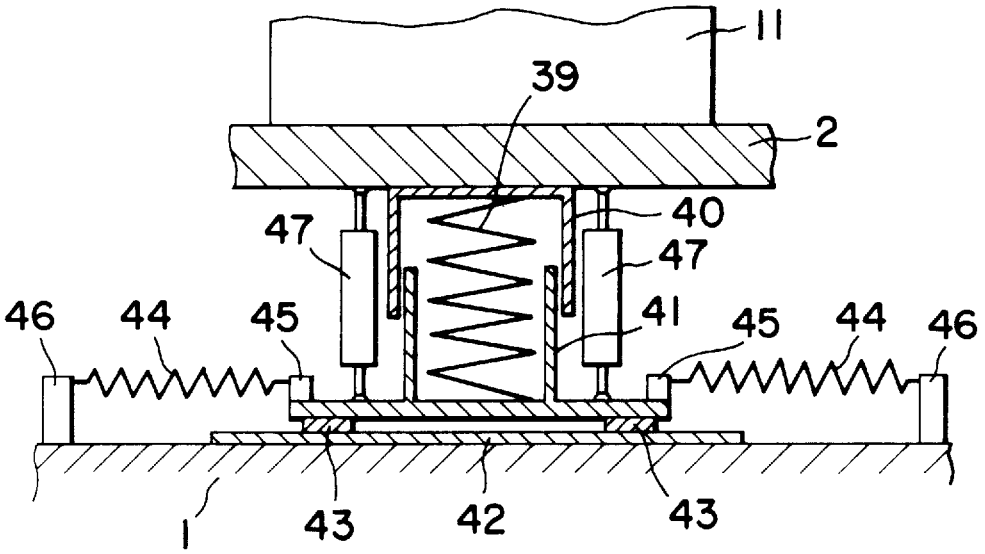
FIG. 13 PRIOR ART
FIG. 13 is a configuration diagram illustrating a still further example of a conventional seismic isolation device.
Figure 14:
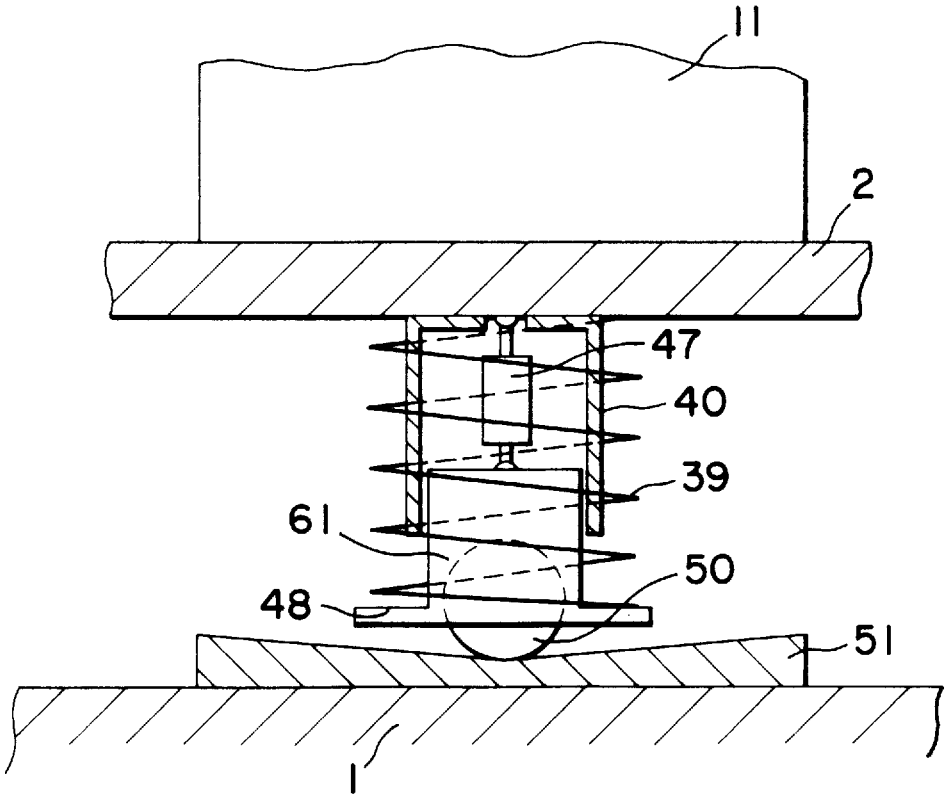
FIG. 14 PRIOR ART
FIG. 14 is a configuration diagram illustrating a still further example of a conventional seismic isolation device.
Figure 15:
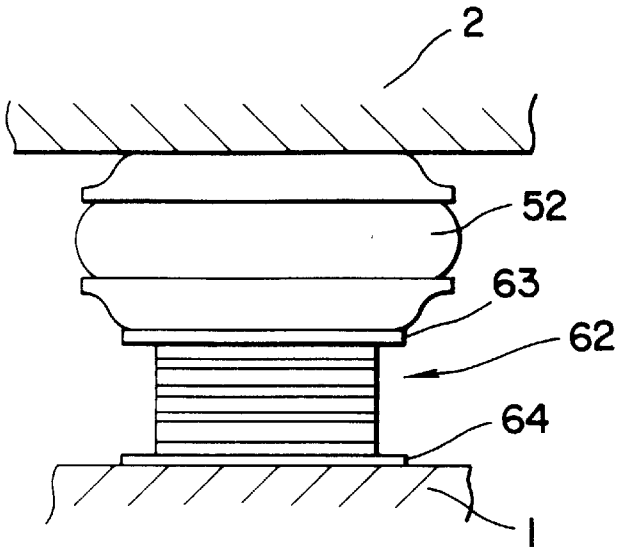
FIG. 15 PRIOR ART
FIG. 15 is a configuration diagram illustrating a still further example of a conventional seismic isolation device.
Figure 16:
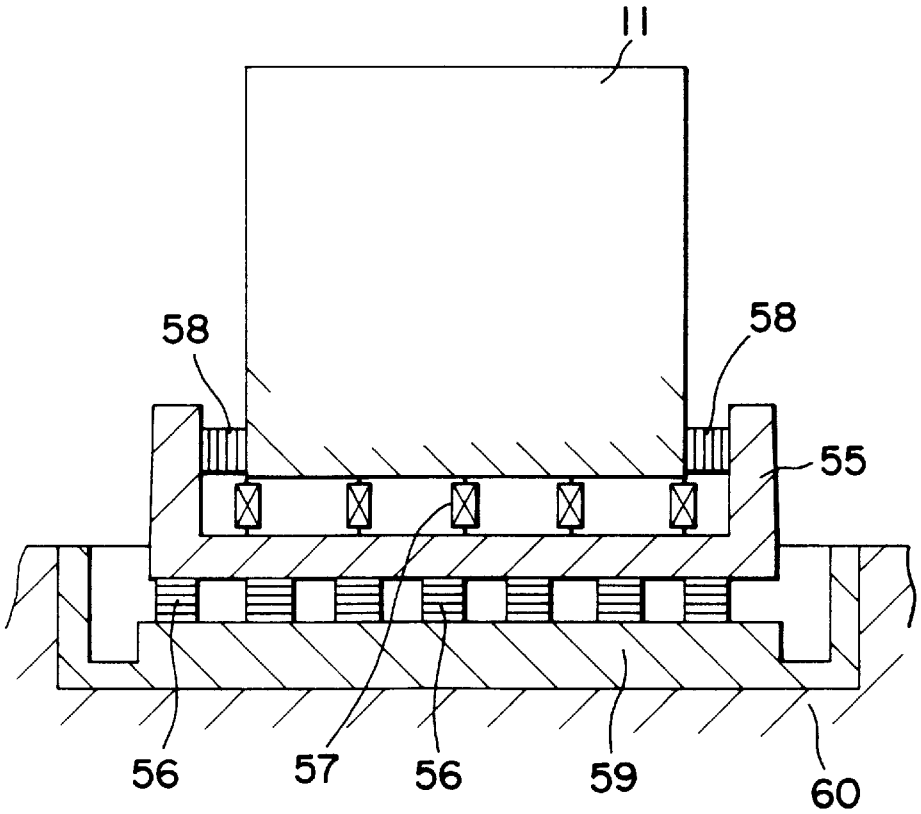
FIG. 16 PRIOR ART
FIG. 16 is a configuration diagram illustrating a still further example of a conventional seismic isolation device.

According to this embodiment, as shown in FIG. 8, a gap is provided on the inner wall of the cylinder 23 so as not to impair relative vertical motion of the cylinder 23 and the travel supporting mechanism 3 to an extent of being horizontally and vertically in contact with the travel supporting mechanism 3, and a cylinder sliding member 37 made of a material having a low frictional coefficient is attached within the foregoing range of contact of the cylinder 23.

In the case of the sixth embodiment shown in FIG. 7A, upon occurrence of an earthquake, when the floor body displaces horizontally and vertically, the travel supporting mechanism 3 is pushed by the cylinder 23 in the horizontal direction and slides vertically while being in contact therewith. At this point, a large frictional force at the sliding portion between the inner wall of the cylinder 23 and the outer wall of the travel supporting mechanism 3 leads to a larger vertical frictional resistance, causes imbalance in the force acting in the vertical direction in each of the vertical seismic isolation devices 23*a* and may cause a complicated vibration in the floor body 2. According to this embodiment, however, the cylindrical sliding member 37, which is a vertical sliding member, made of a material having a lower frictional coefficient than that of the travel supporting mechanism 3 or the cylinder 23 is attached to the inner wall of the cylinder 23. Therefore, even when the sliding occurs with the outer wall of the travel supporting mechanism 3, the produced frictional force is small, the vertical motion is smooth, and the probability of causing an imbalanced vibration of the floor body 2 by frictional force is very limited.

It is thus possible to reduce the vertical frictional force, achieve a smoother motion and allow full display of the vertical seismic isolating ability.

Further, it is to be noted that the present invention is not limited to the described embodiments and many other changes and modifications may be made without departing from the scopes of the appended claims.

What is claimed is:

1. A seismic isolation device comprising:

a floor body which is arranged on a structural floor and to which an object of seismic isolation is mounted;

a first restoring means disposed on the structural floor and adapted to impart a horizontal restoring force to the floor body when the floor body is horizontally displaced with respect to the structural floor;

a first damping device arranged in association with the first restoring means and adapted to impart a horizontal damping force when the floor body is horizontally displaced with respect to the structural floor;

a first engaging member projecting from the floor body towards the structural floor;

a second engaging member provided on the first restoring means and sliding while coming into contact with the first engaging member;

a second restoring means disposed to a lower portion of the floor body and adapted to impart a vertical restoring force when the floor body is vertically displaced with respect to the structural floor;

a second damping device arranged in association with the second restoring means and adapted to impart a vertical damping force when the floor body is vertically displaced with respect to the structural floor; and a support means for supporting the floor body to be movable in a horizontal direction;

wherein said first restoring means comprises a pair of opposing guide mechanisms disposed on the structural floor, a pair of opposing sliding members provided between the guide mechanisms to be slidable only in the opposing direction thereof, an elastic body connecting the paired sliding members and a first stop member adapted to prevent the respective sliding members from coming within a prescribed distance, and said second engaging member is mounted to the sliding members of the first restoring means and comprises a rotary member which slides while being in contact with said first engaging member and a shaft member supporting the rotary member through a bearing.

2. A seismic isolation device according to claim 1, wherein said elastic body comprises a spring means disposed between the sliding members.

3. A seismic isolation device according to claim 2, wherein said first damping device is provided for the first restoring means so as to be disposed between the sliding members and adapted to change a kinetic energy thereof to a thermal energy to damp a horizontal quake.

4. A seismic isolation device according to claim 1, wherein said rotary member has a vertical length longer than a sum of a vertical length of a contact member of the first engaging member in contact with the rotary member and twice a prescribed maximum anticipated vertical displacement previously determined of the floor body, and wherein said rotary member of the second engaging member has an upper end portion disposed at a position higher in level than an upper end of the contact member of the second engaging member with a difference in height over the maximum anticipated vertical displacement of the floor body upon an occurrence of an earthquake and said rotary member has a lower end disposed at a position lower in level than a lower end of the contact member of the upper engaging member with a difference in height over the maximum anticipated vertical displacement of the floor body upon the occurrence of an earthquake.

5. A seismic isolation device according claim 4 wherein the contact member having a frictional coefficient lower than that of the first engaging member is provided on a contact surface of the first engaging member contacting the second engaging member.

6. A seismic isolation device according to claim 5, wherein an elastic member having a rigidity lower than that of the first engaging member is inserted between said contact member having a lower frictional coefficient provided on said contact surface and the first engaging member.

7. A seismic isolation device according to claim 1, wherein a plurality of said first restoring device and said first damping means are disposed on the structural floor with respect to the floor body.

8. A seismic isolation device according to claim 1, wherein a cylindrical member is mounted to the floor body so as to extend towards the structural floor and wherein said second restoring device and said second damping means are accommodated in the cylindrical member.

9. A seismic isolation device according to claim 1, wherein a plurality of cylindrical members are mounted to the floor body.

10. A seismic isolation device according to claim 1, wherein said support means is provided with a bearing means through which the support means is slidable on the structural floor.

11. A seismic isolation device according to claim 1, wherein said second restoring means comprises a spiral elastic body and said second damping device is housed in the second restoring means.

12. A seismic isolation device according to claim 11, wherein said floor body is supported by said support means through a cylindrical member.

13. A seismic isolation device according to claim 12, wherein said support means is housed in said cylindrical member.

14. A seismic isolation device according to claim 11, wherein a vertical natural frequency of said second restoring means relative to a total weight of the floor body and the object of seismic isolation is larger than a horizontal natural frequency of the first restoring means relative to the total weight of the floor body and the object of seismic isolation and wherein a vertical attenuation constant of the second damping device relative to the total weight of the floor body and the object of seismic isolation is larger than a horizontal attenuation constant of the first damping device relative to the total weight of the floor body and the object of seismic isolation.

15. A seismic isolation device according to claim 14 further comprising a second stop member which constrains mutual relative motion when the vertical relative displacement between the lower end of a cylindrical member housing the spiral elastic body and the upper end of the support means movable in the horizontal direction is smaller than a predetermined value and a vertical distance between the upper end of the support means and the lower end of the cylindrical member upon installation of the second stop member is longer than a prescribed maximum anticipated vertical displacement previously determined for the floor body upon an occurrence of an earthquake.

16. A seismic isolation device according to claim 14, further comprising a vertical sliding member composed of a material having a frictional coefficient lower than that of either one of the support means and a cylindrical member, which is inserted between an inner wall of the cylindrical member and the support means so as to constrain only a horizontal relative displacement between the support means and the cylindrical member while being in contact with the support means.

17. A seismic isolation device comprising:

a floor body which is arranged on a structural floor and to which an object of seismic isolation is mounted;

a first restoring means disposed on the structural floor and adapted to impart a horizontal restoring force to the floor body when the floor body is horizontally displaced with respect to the structural floor;

a first device means arranged in association with the first restoring means and adapted to impart a horizontal damping force when the floor body is horizontally displaced with respect to the structural floor;

a first engaging member projecting from the floor body towards the structural floor;

a second engaging member provided on the first restoring means and sliding while coming into contact with the first engaging member;

a second restoring means disposed to a lower portion of the floor body and adapted to impart a vertical restoring force when the floor body is vertically displaced with respect to the structural floor;

a second damping device arranged in association with the second restoring means and adapted to impart a vertical damping force when the floor body is vertically displaced with respect to the structural floor; and a support means for supporting the floor body to be movable in a horizontal direction;

wherein a cylindrical member is mounted to the floor body so as to extend towards the structural floor, said second restoring means and said second damping device being accommodated in the cylindrical member, said second restoring means comprising a spiral elastic body and said second damping device is housed in the second restoring means, wherein a vertical natural frequency of said second restoring means relative to a total weight of the floor body and the object of seismic isolation is larger than a horizontal natural frequency of the first restoring means relative to the total weight of the floor body and the object of seismic isolation, and wherein a vertical attenuation constant of the second damping device relative to the total weight of the floor body and the object of seismic isolation is larger than a horizontal attenuation constant of the first damping means relative to the total weight of the floor body and the object of seismic isolation.

18. A seismic isolation device according to claim 17, wherein said floor body is supported by said support means through a cylindrical member.

19. A seismic isolation device according to claim 18, wherein said support means is housed in said cylindrical member.

20. A seismic isolation device according to claim 17, further comprising a second stop member which constrains mutual relative motion when the vertical relative displacement between the lower end of a cylindrical member housing the spiral elastic body and the upper end of the support means movable in the horizontal direction is smaller than a value of 0 and a vertical distance between the upper end of the support means and the lower end of the cylindrical member upon installation of the second stop member is longer than a prescribed maximum anticipated vertical displacement previously determined for the floor body upon an occurrence of an earthquake.

21. A seismic isolation device according to claim 17 further comprising a vertical sliding member composed of a material having a frictional coefficient lower than that of either one of the support means and a cylindrical member, which is inserted between an inner wall of the cylindrical member and the support means so as to constrain only a horizontal relative displacement between the support means and the cylindrical member while being in contact with the support means.

* * * * *